US006827158B1

(12) United States Patent
Dimitroff et al.

(10) Patent No.: US 6,827,158 B1
(45) Date of Patent: Dec. 7, 2004

(54) TWO-PIPE ON-GRADE DIRECTIONAL BORING TOOL AND METHOD

(75) Inventors: Ted Dimitroff, Columbia, MO (US); Paul W. Knecht, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 10/210,195

(22) Filed: Jul. 31, 2002

(51) Int. Cl.[7] ..... E21B 7/04; E21B 7/08

(52) U.S. Cl. ..... 175/62; 175/61; 175/45; 175/173

(58) Field of Search ..... 175/61, 62, 45, 175/398, 376, 256, 173, 73; 340/853.4, 853.6

(56) References Cited

U.S. PATENT DOCUMENTS

| | | | | | |
|---|---|---|---|---|---|
| 4,597,454 | A | * | 7/1986 | Schoeffler | 175/61 |
| 4,732,223 | A | * | 3/1988 | Schoeffler et al. | 175/73 |
| 4,811,798 | A | * | 3/1989 | Falgout et al. | 175/73 |
| 4,895,214 | A | * | 1/1990 | Schoeffler | 175/38 |
| 4,953,638 | A | * | 9/1990 | Dunn | 175/61 |
| RE33,660 | E | * | 8/1991 | Jelsma | 175/107 |
| 5,264,795 | A | | 11/1993 | Rider | 324/326 |
| 5,265,682 | A | * | 11/1993 | Russell et al. | 175/45 |
| 5,427,475 | A | | 6/1995 | Coss | 405/184 |
| 5,484,029 | A | * | 1/1996 | Eddison | 175/73 |
| 5,490,569 | A | | 2/1996 | Brotherton et al. | 175/61 |
| 5,682,956 | A | | 11/1997 | Deken et al. | 175/19 |
| 5,703,484 | A | | 12/1997 | Bieberdorf et al. | 324/207.22 |
| 5,799,740 | A | | 9/1998 | Stephenson et al. | 175/62 |
| 5,850,624 | A | | 12/1998 | Gard et al. | 702/92 |
| 5,875,859 | A | * | 3/1999 | Ikeda et al. | 175/73 |
| 5,880,680 | A | | 3/1999 | Wisehart et al. | 340/853.4 |
| 5,924,500 | A | | 7/1999 | Puttmann | 175/61 |
| 6,012,536 | A | | 1/2000 | Puttmann et al. | 175/21 |
| 6,109,371 | A | | 8/2000 | Kinnan | 175/61 |
| 6,244,361 | B1 | * | 6/2001 | Comeau et al. | 175/61 |
| 6,311,790 | B1 | | 11/2001 | Beckwith et al. | 175/62 |
| 6,484,819 | B1 | | 11/2002 | Harrison | 175/61 |

FOREIGN PATENT DOCUMENTS

| | | | |
|---|---|---|---|
| DE | 199 23 555 C1 | 11/2000 | E21B/7/06 |
| WO | WO 01/57353 A2 | 8/2001 | |

OTHER PUBLICATIONS

Gary Lawson, "Water and Sewer Construction With Horizontal Directional Drilling Equipment" Proceedings of North American No—DIG 2002 conference, Apr. 28–30, 2002.

"Wilmington, Ohio, Solves Sewer Installation Problem With Directional Drilling", from Vermeer Manufacturing Company website, Jun. 2002.

"Locating a Gravity Sewer Bore?", Trenchless Technology, Aug. 2002, pp. 58–59.

"Dual Effort", Underground Construction, Sep. 2002, pp. 50–51.

* cited by examiner

*Primary Examiner*—William Neuder
*Assistant Examiner*—Shane Bomar
(74) *Attorney, Agent, or Firm*—McKinney & Stringer, P.C.

(57) ABSTRACT

A method and apparatus for boring a close tolerance on-grade subsurface borehole. A downhole tool assembly for use with a dual member drill string comprises a directional boring tool. The dual member drill string comprises an outer member and an inner member disposed within the outer member and rotatable independently of the outer member. The downhole tool assembly permits the directional boring tool to be connected to the inner member of the drill string. Rotation of the inner member of the drill string causes rotation of the boring tool. The borehole is drilled in a straight manner by rotating the boring tool with the inner member of the drill string and simultaneously advancing the drill string through the earth. The borehole direction is changed by orienting the directional boring tool with the inner member of the drill string and then advancing the drill string without rotation.

29 Claims, 6 Drawing Sheets

TWO-PIPE ON-GRADE DIRECTIONAL BORING TOOL AND METHOD

FIELD OF THE INVENTION

The present invention relates to apparatus and method for drilling horizontal underground boreholes, in particular horizontal underground boreholes requiring a close tolerance on-grade slope or horizontal segment.

SUMMARY OF THE INVENTION

The present invention is directed to a method for drilling a close tolerance on-grade subsurface borehole using a dual member drill string and a downhole tool assembly. The dual member drill string comprises an outer member and an inner member disposed within the outer member and rotatable independent of the outer member. The method comprises rotating the downhole tool solely by rotating the inner member of the drill string and simultaneously advancing the downhole tool assembly to bore a substantially straight segment of the borehole. The method further comprises changing direction of the borehole by advancing the downhole tool assembly without rotation.

In another aspect the invention is directed to a downhole tool assembly for a dual member drill string, the dual member drill string comprising an outer member and an inner member disposed within the outer member. The downhole tool assembly comprises a bearing housing assembly, a directional boring tool, and a drive member. The bearing housing assembly is connectable to a downhole end of the outer member of the drill string and is characterized by an outer wall defining an interior bearing chamber with a straight central axis. The drive member has a front portion, a body, and a rear portion. The front portion is adapted to be operatively connected in torque transmitting engagement to the directional boring tool. The body is supported within the interior bearing chamber. The rear portion is operably connectable in torque transmitting engagement with a downhole end of the inner member of the drill string.

In yet another aspect, the present invention is directed to a horizontal directional drilling machine comprising a frame, a dual member drill string, a dual-rotary drive system, and a downhole tool assembly. The drill string comprises an outer member and an inner member disposed generally coaxially within the outer member, the outer member and inner members having first respective ends and second respective ends. The dual-rotary drive system is attachable to the frame and operatively connectable to the first respective ends of the dual-member drill string. The dual-rotary drive system is adapted to rotate and advance the drill string. The downhole tool assembly comprises a bearing housing assembly, a directional boring tool, and a drive member. The bearing housing assembly is connectable to the second end of the outer member and is characterized by an outer wall defining an interior bearing chamber with a straight central axis. The drive member is characterized by a front portion, a body, and a rear portion. The front portion is operably connectable in torque transmitting engagement to the second end of the inner member. The body is supported within the interior bearing chamber. The rear portion is adapted to be operatively connected in torque transmitting engagement to the directional boring tool.

BRIEF DESCRIPTION OF THE DRAWINGS

FIG. 6 is a side elevational cross-sectional view of an alternative embodiment of the downhole tool assembly of the present invention.

DETAILED DESCRIPTION OF THE PREFERRED EMBODIMENTS

Horizontal directional drilling (HDD) permits installation of utility services or other products underground in an essentially "trenchless" manner, eliminating surface disruption along the length of the project and reducing the likelihood of damaging previously buried products. The typical HDD borepath begins from the ground surface as an inclined segment that is gradually leveled off as the desired product installation depth is neared. This depth is maintained—or a near horizontal path may be desirable instead—for the specified length of the product installation.

Commonly installed utilities via HDD machines include electrical lines, telephone lines, fiber optic data lines, and water and gas mains and services. However, use of these machines to install on-grade gravity flow sewers has been very limited, because creating a borehole with the critical grade required for these installations has often been impractical. There remains a need for systems to provide on-grade installation of utilities.

Figure 1:
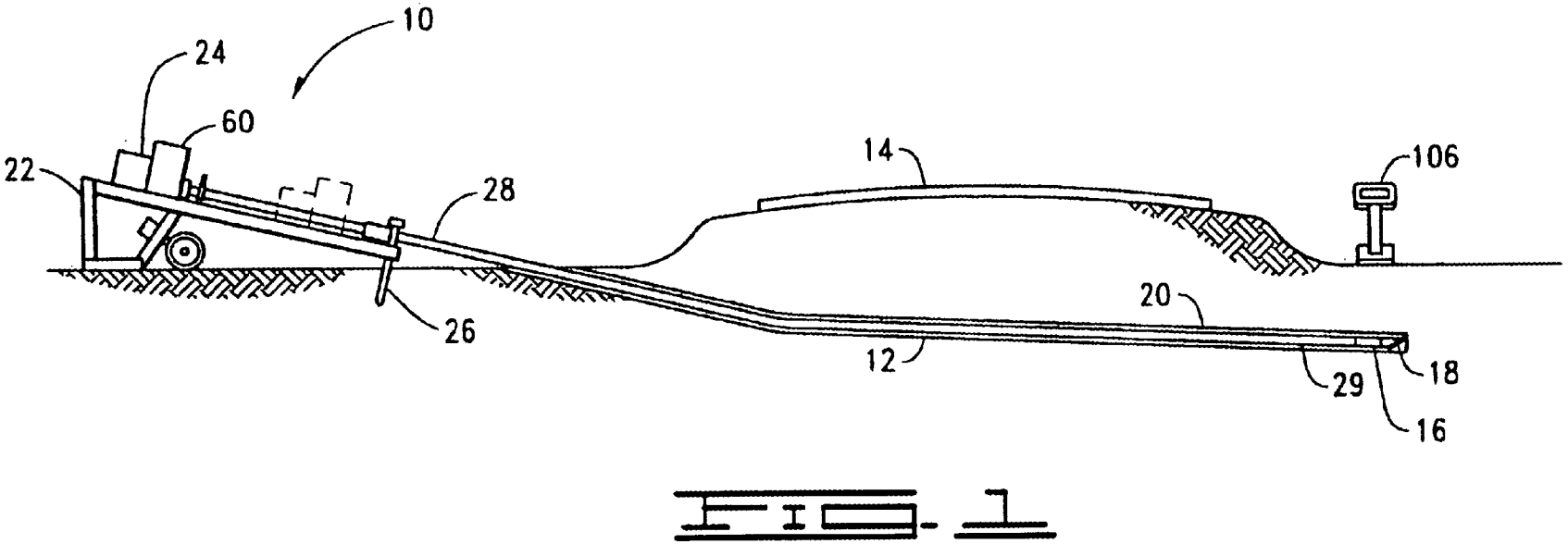
FIG. 1 depicts a horizontal directional drilling system having a dual-drive spindle for operating a dual-member drill string for use in accordance with the present invention.

With reference now to the drawings in general and FIG. 1 in particular, there is shown therein a horizontal directional drilling machine 10 suitable for the subsurface placement of utility services on-grade. FIG. 1 illustrates the usefulness of horizontal directional drilling by demonstrating that a borehole 12 can be made without disturbing an above-ground structure, namely the roadway as denoted by reference numeral 14. FIG. 1 also illustrates the present invention by showing the use of a downhole tool assembly 16, comprising a directional boring tool 18, operatively connected to a drill string 20. As used herein, a directional boring tool is intended to refer any drilling bit or boring tool which may cause deviation of the tool from a straight path when thrust forward without rotation or when thrust forward with oscillatory rotation. A directional boring tool used with the present invention, when operated in accordance with the present invention, will have a steering capability to enable the downhole tool assembly 16 to direct the path of the borehole 12.

Referring still to FIG. 1, the horizontal directional drilling machine 10 generally comprises a frame 22, for supporting a rotary drive system 24, and an earth anchor 26. The rotary drive system 24 is movably supported on the frame 22 between a first position and a second position by a carriage 60. Movement of the rotary drive system 24, by way of an axial advancement means (not shown), between the first position and the second position axially advances the drill string 20 and directional boring tool 18 through the borehole 12. The earth anchor 26 is driven into the earth to stabilize the frame 22 against the axial force exerted by movement of the rotary drive system 24 during axial advancement of the directional boring tool 18.

The drill string 20 is operatively connected to the rotary drive system 24 at a first end 28. The downhole tool assembly 16 and the directional boring tool 18 are operatively connected to a downhole second end 29 of the drill string 20. The drill string 20 transmits torque and thrust to the directional boring tool 18 to drill the subsurface borehole 12.

Figure 2:
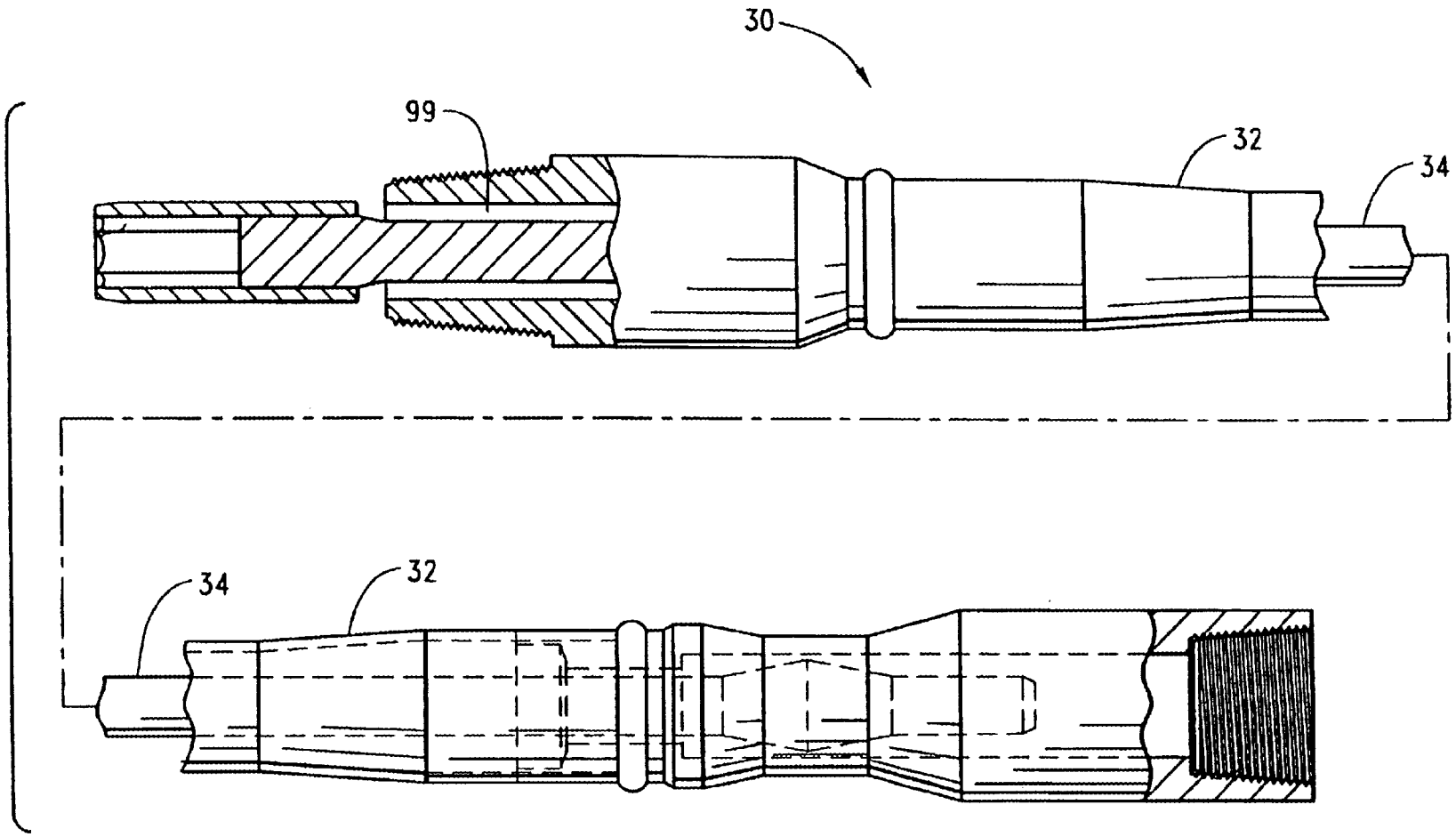
FIG. 2 is a fragmented, side elevational, partly sectional view of a pipe section used with a dual-member drill string.

In accordance with the present invention, the drill string 20 comprises a dual-member drill string. The dual-member drill string 20 may comprise a plurality of dual-member pipe sections or pipe joints. Turning now to FIG. 2, there is shown one of a plurality of dual-member pipe sections 30 comprising the dual-member drill string 20. The dual-member pipe section 30 comprises a hollow outer member 32 and an inner member 34 positioned longitudinally therein. Preferably, the inner member 34 is disposed generally coaxially within the outer member 32. The inner member 34 and outer member 32 are connectable with the inner members and outer members of adjacent dual-member pipe sections to form the dual-member drill string 20. The interconnected inner members 34 are rotatable independently of the interconnected outer members 32. As will be described later, the independent rotation of the inner members 34 allows the inner members to drive operation of the directional boring tool 18. It will be appreciated that any dual-member drill string having an outer member and an inner member, the inner member disposed within the outer member and independently rotatable, may be used with the present invention. Embodiments for suitable dual member drill strings are described in U.S. Pat. No. 5,490,569, issued to Brotherton, et al., and U.S. Pat. No. 5,682,956, issued to Deken et al., the contents of which are incorporated herein by reference.

Figure 3:
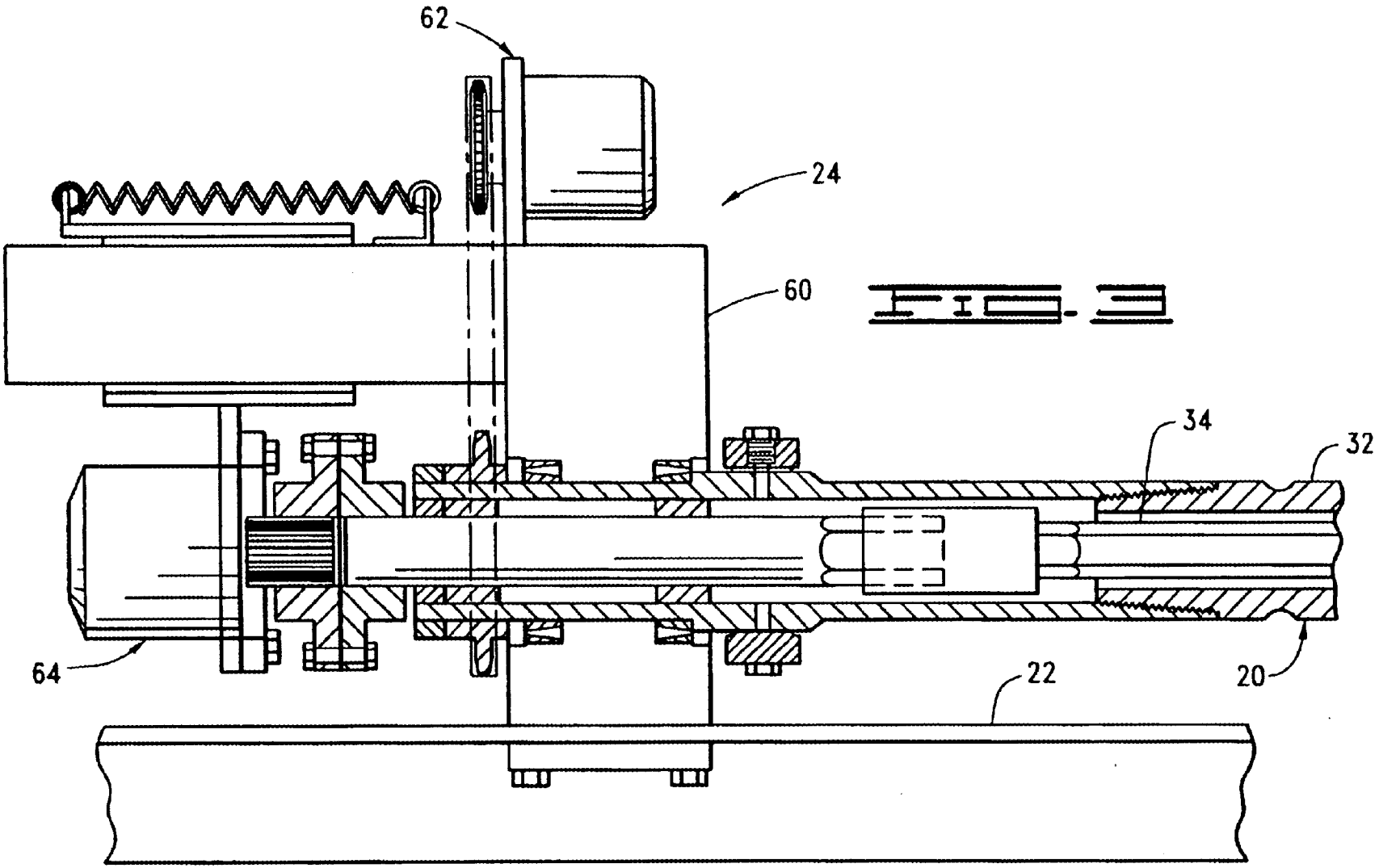
FIG. 3 shows a fragmented, side elevational, cross-sectional view of the rotary drive system of the present invention.

Turning now to FIG. 3, the rotary drive system 24 for driving the drill string 20 is shown in more detail. Because the outer member 32 and inner member 34 rotate independently of each other, the rotary drive system 24 has two independent drive groups for independently driving the interconnected outer members and interconnected inner members comprising the drill string 20.

The rotary drive system 24 thus preferably comprises the carriage 60 supported on the frame 22. Supported by the carriage 60 is an outer member drive group 62 and an inner member drive group 64. The outer member drive group 62 drives the interconnected outer members 32. The inner member drive group 64, also called the inner member drive shaft group, drives the interconnected inner members 34 and, as will be described subsequently, the directional boring tool 18. The rotary drive system 24 also comprises a biasing assembly for urging engagement of the inner members 34. A suitable rotary drive system 24 having an outer member drive group 62 for driving the interconnected outer members 32 and an inner member drive group 64 for driving the interconnected inner members 34 is disclosed in U.S. Pat. No. 5,682,956, issued to Deken, et al., which is incorporated herein by reference.

Figure 4:
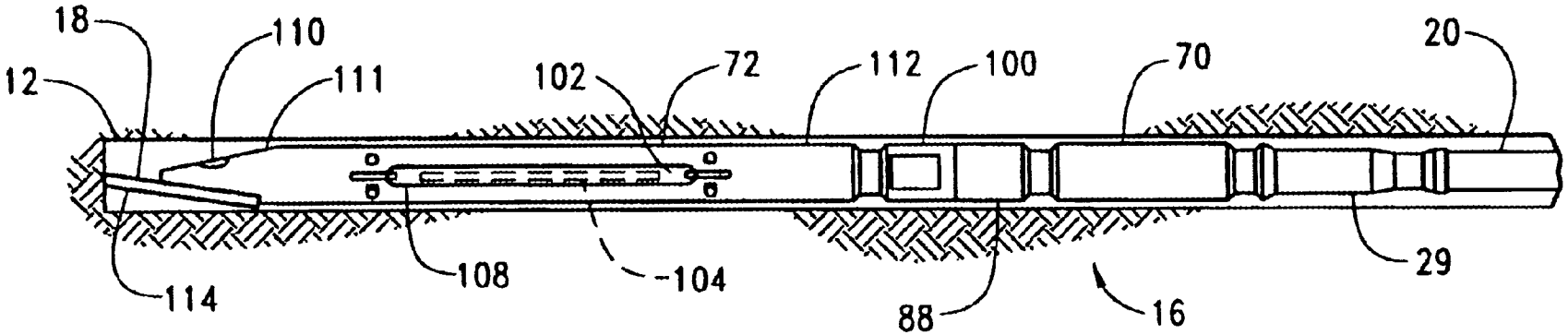
FIG. 4 is a side elevational, partly sectional view of an embodiment of the downhole tool assembly of the present invention, shown in a cut-away side view of the borehole being drilled.

With reference now to FIG. 4, there is shown therein a downhole tool assembly 16 constructed in accordance with the present invention. The downhole tool assembly 16 is connected to the downhole end 29 of the drill string 20. The downhole tool assembly 16 comprises a bearing housing assembly 70, a beacon housing assembly 72, and the directional boring tool 18.

Figure 5:
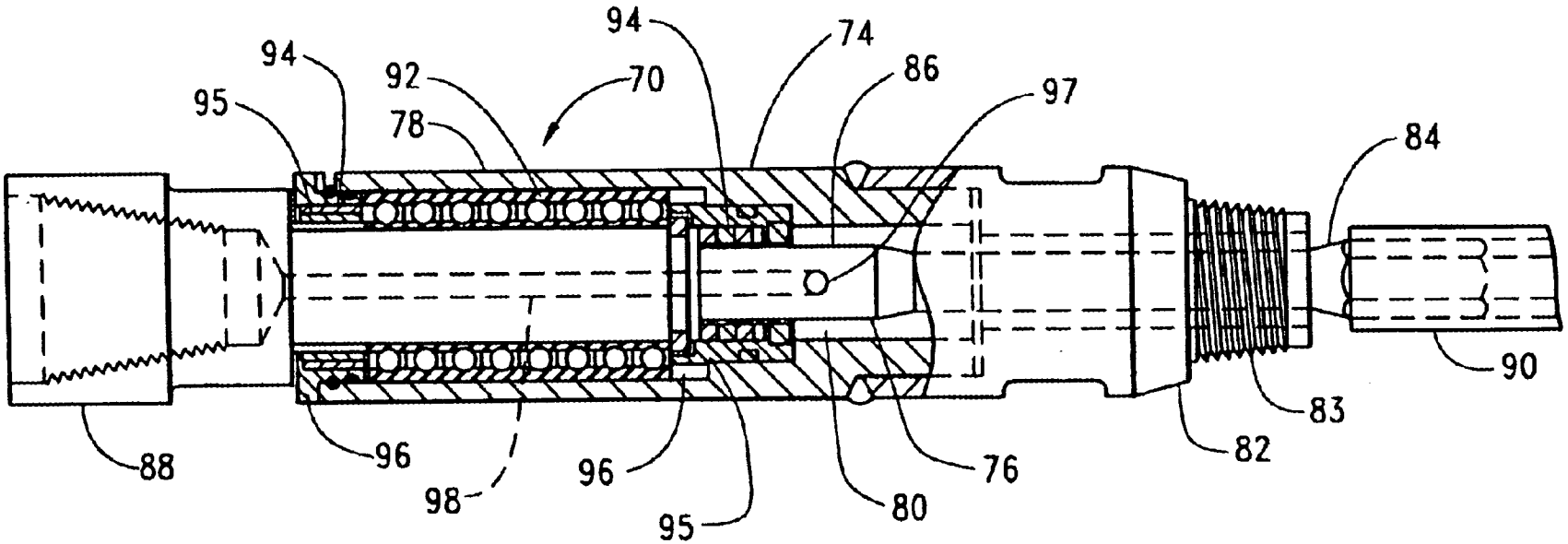
FIG. 5 is a partial cut-away side view of the bearing housing assembly of the present invention.
Figure 3:
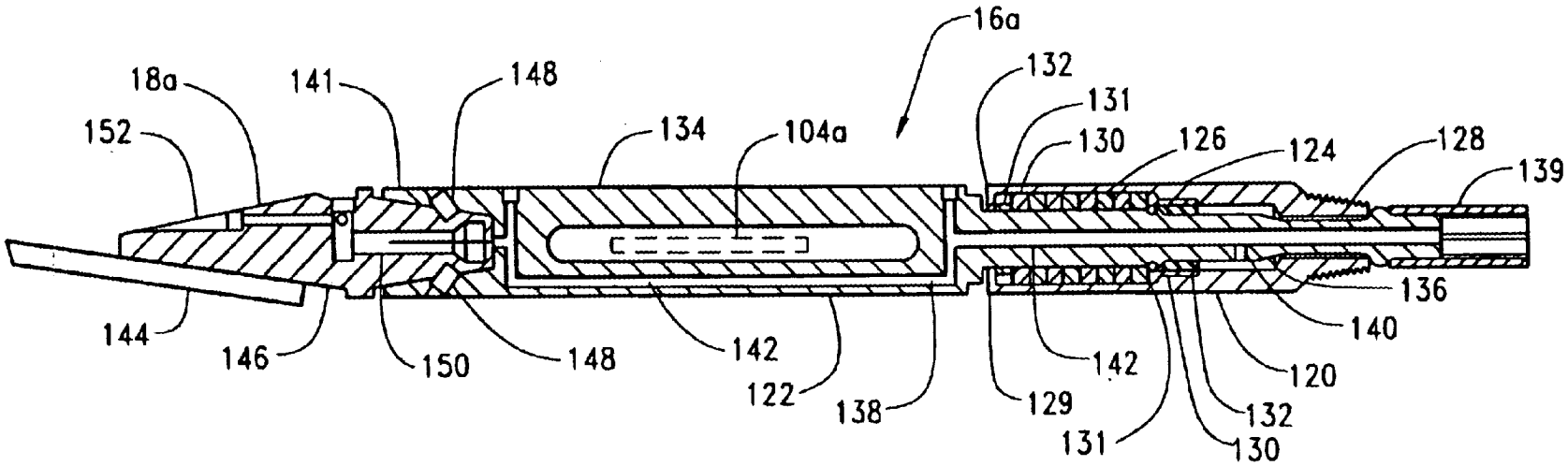

The bearing housing assembly 70, shown in greater detail in FIG. 5, comprises a housing 74 with a straight central axis and an inner drive member 76. The housing 74 has an outer wall 78 that defines an interior bearing chamber 80. A rear end 82 of the housing 74 is connectable to the outer member 32 at the downhole end 29 of the drill string 20. As shown in FIG. 5, the housing 74 has male threading 83 for connection to a threaded female receiving connection on the outer member 32 of the drill string 20. However, it should be understood that other torque transferring connections and configurations for the connections between the housing 74 and the drill string 20 are contemplated.

The inner drive member 76 is bearingly supported within the housing 74. Thus, the inner drive member 76 is rotatable independently of the housing 74. The inner drive member 76 has a rear portion 84, a body 86, and a front portion 88. The rear portion 84 extends out from the housing 74 and is connectable to the inner member 34 at the downhole end 29 of the drill string 20 such that torque of the inner member 34 is transferred to the inner drive member 76. Preferably, the rear portion 84 comprises a geometrically shaped female connection 90 for connecting to a similarly shaped male connection on the inner member 34 at the downhole end 29 of the drill string 20. As previously indicated, other torque transferring connections and configurations for the connections between the inner drive member 76 and the drill string 20 are contemplated.

The body 86 of the inner drive member 76 is supported within the bearing chamber 80 of the housing 74 by a bearing arrangement 92. Preferably, the bearings 92 are sealed and position the inner drive member 76 generally coaxially within the housing 74. In the preferred embodiment, seals 94, wear rings 95, and seal glands 96 are positioned to retain the bearings 92 in position around the body 86. Preferably, the sealed bearings 92 are periodically lubricated via a pluggable point of access (not shown). This arrangement prevents slurried drill cuttings from reaching and damaging the bearings 92.

The front portion 88 of the inner drive member 76 is operatively connectable to the beacon housing assembly 72, yet to be described. In the preferred embodiment, the front portion 88 comprises a female threaded connection. The inner drive member 76, then, passes through the housing 74 and is independently rotatable of the housing. Thus, when the bearing housing assembly 70 is connected to the drill string 20, the inner member 34 and the inner drive member 76 can be rotated while the outer member 32 and the housing 74 are held without rotation.

Preferably, the inner drive member 76 further comprises at least one fluid portal 97 and a fluid passage 98 for communicating drilling fluid from the annular space 99 (shown in FIG. 2) between the inner member 34 and the outer member 32 of the drill string 20 to the downhole tool assembly 16. One skilled in the art will appreciate the use of drilling fluids during horizontal directional drilling for purposes such as cooling the directional boring tool 18 and the beacon (yet to be described), and to stabilize the borehole. The fluid portal 97 is located in the body 86, positioned near the rear portion 84 and outside of where the body is supported by the bearing arrangement 92. The fluid passage 98 extends from the fluid portal 97, through the interior of the body 86, and to the front portion 88 of the inner drive member 76. It will be understood that this structure permits drilling fluid to flow from the annular space 99 through the body 86, and past the bearing arrangement 92, to other components of the downhole tool assembly 16.

With reference again to FIG. 4, the downhole tool assembly 16 further comprises an adapter 100. Adapter 100 is a threaded pin-to-pin connector to mate the threaded female connection at the front portion 88 of inner drive member 76 to a threaded female connection on the beacon housing assembly 72, yet to be described. However, the need for the adapter 100 could be omitted by configuring the front portion 88 of the inner drive member 76 to connect directly to the beacon housing assembly 72. One skilled in the art will appreciate that the threaded connections and configurations between the parts are shown merely to illustrate a preferred embodiment. It will be appreciated that any torque transmitting connection permitting the rotation of the inner member 34 and the inner drive member 76 to be transferred to the beacon housing assembly 72 and the directional boring tool 18 would be appropriate. The inner drive member 76 could, for example, be integrally formed with the beacon housing assembly 72 or the directional boring tool 18.

The beacon housing assembly 72 comprises a chamber 102 for housing a conventional transmitter or beacon 104 disposed within the housing assembly. Preferably, a conventional beacon 104 for use with the present invention will include one or more sensors internal to the beacon for measuring information representative of one or more of three angular orientations of the downhole tool assembly 16: roll, pitch and yaw. This information is attached, by well-known amplitude or frequency modulation techniques, onto a signal transmitted by the beacon 104 to an above-ground receiver 106 (shown in FIG. 1). The signal transmitted by the beacon 104 is processed to determine the position and orientation of the downhole tool assembly 16 and the directional boring tool 18. One skilled in the art will appreciate that sensors of the beacon 104 must provide orientation information with accuracy for the intended application of the present invention of drilling close tolerance boreholes. For on-grade applications, the beacon 104 is generally referred to as a "grade" beacon.

As shown in FIG. 4, the beacon housing assembly 72 has a side-entry chamber 102 to receive the beacon 104, which is held therein by a slotted retaining cover 108. It should be noted that a front-loading or end-loading beacon housing assembly could also be utilized without departing from the spirit of the invention. Preferably, the beacon 104 and internal sensors are maintained in parallel axial alignment with respect to the central axis of the beacon housing assembly 72. Beacons and associated internal sensors suitable for use with the present invention are disclosed in U.S. Pat. No. 5,264,795, issued to Rider, U.S. Pat. No. 5,703,484, issued to Bieberdorf, et al., U.S. Pat. No. 5,850,624, issued to Gard, et al., and U.S. Pat. No. 5,880,680, issued to Wisehart, et al., the contents of which are incorporated herein by reference.

The beacon housing assembly 72 further comprises a fluid passage (not shown) to permit drilling fluid to flow from the bearing housing assembly 70 through the beacon housing assembly 72. As will be discussed in more detail with regard to the embodiment of FIG. 6, the fluid passage preferably is directed around the beacon 104 and internal sensors to a nozzle 110 at a front end 111 of the beacon housing assembly 72.

As previously discussed, the beacon housing assembly 72 has a threaded connection at a rear end 112 for connection to the adapter 100 and thereby to the inner drive member 76 of the bearing housing assembly 70. The directional boring tool 18 is attached to the front end 11I of the beacon housing assembly 72. As shown in the preferred embodiment of FIG. 4, the directional boring tool 18 comprises a flat blade drill bit 114. The front end 111 of the beacon housing assembly 72 is configured for the attachment of a flat blade drill bit 114. Preferably, the flat blade drill bit 114 is bolted on at an acute angle of approximately 10° to the central axis of the beacon housing assembly 72. While the flat blade drill bit 114 is shown herein, it should be noted that any other directional boring tool which may cause deviation of the tool from a straight path when thrust forward without rotation, or when thrust forward with oscillatory rotation, may be used with the present invention. Such bits include single roller cone bits, carbide studded cobble drilling bits, and replaceable tooth rock drilling bits. Likewise, the connection between the directional boring tool 18 and the beacon housing assembly 72 may be adapted to accommodate the boring tool being used. Directional boring tools suitable for use with the present invention are described in U.S. Pat. No. 5,799,740, issued to Stephenson, et al., and U.S. Pat. No. 6,311,790, issued to Beckwith et al., the contents of which are incorporated herein by reference.

Turning now to FIG. 6, there is shown therein an alternative embodiment for the downhole tool assembly of the present invention. The downhole tool assembly **16*a* shown in FIG. 6 is connectable to the downhole end 29 of the drill string 20. The downhole tool assembly 16*a* comprises a bearing housing assembly 120, a beacon housing assembly 122, and a directional boring tool 18*a***.

The bearing housing assembly 120 comprises a housing 124 and a bearing arrangement 126. The housing 124 has a first end 128 for connection to the outer member 32 at the downhole end 29 of the drill string 20. As shown, the first end 128 comprises a threaded connection. However, as previously discussed, any torque transferring connection for mating the outer member 34 to the bearing housing assembly 120 would be appropriate. A second end 129 of the housing 124 is open for receiving the beacon housing assembly 122 in a manner yet to be described.

The bearing arrangement 126 is disposed within the housing 124 to support the extension arm of the beacon housing assembly 122, yet to be described. Preferably, the bearings 126 are sealed and position the extension arm of the beacon housing assembly 122 generally coaxially within the housing 124. In the preferred embodiment, seals 130, wear rings 131, and seal glands 132 are positioned to retain the bearings 126 in position. Preferably, the sealed bearings 126 are periodically lubricated via a pluggable point of access (not shown). This arrangement prevents slurried drill cuttings from reaching and damaging the bearings 126.

With further reference to FIG. 6, the beacon housing assembly 122 comprises a housing 134 and an extension arm 136. The extension arm 136 extends from a back end 138 of the housing 134. The extension arm 136 is configured to be received by the open second end 129 of the bearing housing assembly 120. The extension arm 136 extends through the bearing housing assembly 120 and is supported by the bearing arrangement 126. The seals 130, wear rings 131, and seal glands 132 of the bearing housing assembly 120 sealingly contain the hearings 126 around the extension arm 136 and prevent slurried drill cuttings from damaging the bearings.

The extension arm 136 extends beyond the bearing housing assembly 120 and is connectable to the inner member 34 at the downhole end 29 of the drill string 20 such that torque of the inner member 34 is transferred to the extension arm 136. Preferably, the extension arm 136 comprises a geometrically shaped female connection 139 for connecting to a similarly shaped male connection on the inner member 34 at the downhole end 29 of the drill string 20. As previously discussed with respect to the inner drive member 76 of the embodiment of FIG. 5, other torque transferring connections and configurations for the connections between the extension arm 136 and the inner member 34 of the drill string 20 are contemplated.

The housing 134 is side-chambered to accept a conventional transmitter or beacon 104*a*, to be disposed within the housing and retained therein by a slotted retaining cover 108*a*. The beacon 104*a* for use with the present embodiment will preferably have the same characteristics and operate in the same way as the beacon 104 described for use with the embodiment of FIG. 5. As was also discussed with respect to the housing 102 of the embodiment of FIG. 5, the housing 134 of the present embodiment could also be a front-loading beacon housing. The housing 134 has a front end 141 configured to receive the directional boring tool 18*a*.

The beacon housing assembly 122 further comprises at least one fluid portal 140 and a fluid passage 142 for communicating drilling fluid from the annular space 99 (shown in FIG. 2) between the inner member 34 and the outer member 32 of the drill string 20 to the downhole tool assembly 16. One skilled in the art will appreciate the use of drilling fluids during horizontal directional drilling for purposes such as cooling the directional boring tool 18*a* and the beacon 104*a*, and to stabilize the borehole. The fluid portal 140 is located on the extension arm 136 proximate the connection to the inner member 34 of the drill string 20. The fluid passage 142 extends from the fluid portal 140, through the extension arm 136, and through the housing 134. Preferably, the fluid passage 142 is deviated to divert fluid flow around the beacon 104*a*. It will be understood that this structure permits drilling fluid to flow from the annular space 99 (shown in FIG. 2) through the bearing housing assembly 120 and the beacon housing assembly 122, to the components of the downhole tool assembly 16*a*.

The directional boring tool 18*a* of the embodiment shown in FIG. 6 comprises a blade bit 144 attached to a blade body 146. The blade body 146 is configured to attach to the front end 141 of the beacon housing assembly 122. Preferably, the blade body 146 is attached to the front end 141 of the beacon housing assembly 122 by a tapered connection and secured with set screws 148. Alternatively, splined-and-pinned or threaded connections could also be used. A fluid passage 150 in the blade body 146 permits drilling fluid flowing through the beacon housing assembly 122 to be ejected through a nozzle 152 at the front end of the blade body. The blade bit 144 is attached to the blade body 146 at acute angle to the longitudinal axis of the downhole tool assembly 16*a*. Preferably, the blade bit 144 is bolted to the blade body 146 at an angle of approximately 10°. As was discussed with regard to the directional boring tool 18 of FIG. 4, one skilled in the art will appreciate that any directional boring tool 16*a* capable of being deviated when advanced without rotation, or when advanced with oscillatory rotation, would be appropriate for use with the present embodiment.

Referring again to the embodiments of FIGS. 4 and 6, with the directional boring tool 18 and 118*a* operatively secured to the beacon housing assembly 72 and 122, the beacon 104 and 104*a* is held in rotationally indexed relation to the orientation of the directional boring tool such that the roll sensor disposed in the beacon 104 and 104*a* correctly indicates the rotational orientation of the directional boring tool. For example, in the orientation shown in FIG. 4, the roll sensor would indicate a 12 o'clock or "steer up" orientation. As the inner member 34 of the drill string 20 is rotated, thereby rotating the inner drive member 76, the beacon housing assembly 72, and the directional boring tool 16, the consummate change in orientation of the boring tool can be detected by the roll sensor.

The present invention also comprises a method for drilling an on-grade subsurface borehole 12. As previously discussed, the directional boring tool 18 and the beacon housing assembly 72 and 122 can be rotated by the inner member 34 of the drill string 20, independent of the rotation of the outer member of the drill string. The outer member 32 of the drill string 20 and the housing 74 and 124 of the bearing housing assembly 70 and 120 can be advanced without rotation in all phases of drilling the pilot borehole 12—i.e., whether drilling a curved or straight segment of the borehole. This structure and functionality provides significant advantages for drilling a close tolerance on-grade borehole. For example, advancing the outer member 32 of the drill string 20 without rotation effectively eliminates any detrimental effect resulting from a rotating drill string impacting or wearing away the sides of the borehole.

Further, when the outer member 32 is of substantially uniform outer diameter, it is less likely that its axial movement along the borehole will abrade the wall. Preferably, the bearing housing assembly 70 and the beacon housing assembly 72 are also of substantially uniform diameter. For example, in the embodiment shown in FIG. 4., the diameter of the bearing housing assembly 70 and the beacon housing assembly 72 is 3.75 inches; compared to the borehole diameter of approximately 4.5 inches. One skilled in the art will also appreciate, however, that beacon housing assembly 72 having an outer diameter less than the outer diameter of the bearing housing assembly 70 may result in lower frictional drag when drilling highly cohesive or sticky clay soils. The rotational torque required of the inner member 34 of the drill string 20 when drilling a straight path segment of the borehole 12 is thus reduced. One skilled in the art will appreciate that a few revolutions of outer member 24 of the drill string 20, repeated on an periodic basis, are helpful to prevent and reduce the build-up of frictional drag within the borehole.

The direction and grade of the borehole 12 drilled in accordance with the present invention is controlled by the orientation of the inner member 34 of the drill string 20 and the directional boring tool 16. To drill a straight segment of a desired borehole path, the drill string is advanced while the directional boring tool 0.16 is rotated by the inner member 34 of the drill string 20. Preferably, the drill string 20 is advanced by using the carriage 60 and the outer member drive group 62 to advance (thrust) the outer member 32 of the drill string. One skilled in the art will appreciate that as the outer member drive group 62 provides thrust to the outer member 32 of the drill string 20, the inner member 34 is also advanced forward. However, it will be appreciated that the drill string 20 can be advanced by thrusting simultaneously with the outer member drive group 62 and the inner member drive group 64 against both the inner member 34 and the outer member 32, or by thrusting against only the inner member 32.

To change the direction of the borehole, the directional boring tool 18 is oriented, by rotation of the inner member 34 of the drill string 20, to the desired direction and held in that orientation. The drill string 20 is then advanced without rotation of inner member 34 of the drill string. It will be appreciated that the directional boring tool 18 may not change direction in certain soil conditions. One skilled in the art will appreciate the use of an oscillatory steering technique in those conditions. One such technique is disclosed in U.S. Pat. No. 6,109,371, issued to Kinnan, the contents of which are incorporated herein by reference. In accordance with the present invention, this technique allows for the direction of the borehole to be changed by orienting the directional boring tool 18 by rotation of the inner member 34. The drill string 20 is then advanced while the directional boring tool 18 is rocked through an arc of partial revolution bisected by the desired direction change.

The following technique used with the present invention is particularly useful for on-grade boring applications where a directional boring tool 16 has been found to be drifting off the desired grade or borepath. In this instance, corrective steering action involves advancing the drill string 20 without rotation of the directional boring tool 18 for a first interval of distance sufficient to initiate corrective action, followed by rotating the directional boring tool with the inner member 34 of the drill string and simultaneously advancing the drill string for a second interval of distance. The pitch of the downhole tool assembly 16 and the directional boring tool 18 can then be checked to determine if a return to the desired pitch has been achieved. The process can be repeated until the desired pitch is achieved.

One skilled in the art will appreciate the first and second intervals of distance will vary depending on the type of soil and the amount of correction required. For "average" soils for example, the thrust without rotation first interval of distance for initiating a course correction may be on the order of 2 to 3 inches. The directional boring tool 18 may then be advanced with rotation for the second interval of distance of approximately 12 inches.

Preferably, the diameter of the bearing housing assembly 70 and the beacon housing assembly 72 approximate the diameter of the borehole to be drilled by the directional boring tool 18. More preferably, the directional boring tool 18, when rotated, drills a borehole diameter as small as 0.5-inch greater in diameter than the diameter of the bearing housing assembly 70 and the beacon housing assembly 72. These dimensional relationships offer additional stability to the borehole and to the drilling and steering action of the downhole tool assembly 16. One skilled in the art will appreciate that the relative sizes may be optimally selected depending on the conditions of the soil where the invention is used.

In summary, the conceived invention allows power to be applied to the soil-cutting member at the end of the drill string using the inner drive member of the two-member drill string. The outer member of the two-member drill string rides along the borehole wall without rotation so that the hole does not undergo the previously described deformation that would be caused by the action of a rotating member in contact with it. The outer member may be used to apply the necessary thrust load to the soil drilling device, or depending on design of the downhole device, may simply act as a shield member to prevent a rotating member from causing borehole deformation.

What is claimed is:

1. A method for drilling an on-grade subsurface borehole using a dual member drill string and a downhole tool assembly, the dual member drill string comprising an outer member and an inner member disposed within the outer member and rotatable independent of the outer member, the method comprising:

rotating the downhole tool assembly solely by rotating the inner member of the drill string and simultaneously advancing the downhole tool assembly to bore a substantially straight segment of the borehole;

changing direction of the borehole by advancing the downhole tool assembly without rotation of the inner member.

2. The method of claim 1 wherein advancing the downhole tool assembly comprises thrusting the outer member of the drill string.

3. The method of claim 1 wherein advancing the downhole tool assembly comprises simultaneously thrusting the outer member and the inner member.

4. The method of claim 1 further comprising advancing the outer member of the drill string through the borehole without rotation.

5. The method of claim 1 further comprising periodically rotating the outer member of the drill string to reduce drag within the borehole.

6. The method of claim 1 wherein advancing the downhole tool assembly without rotation comprises advancing the drill string while rocking the downhole tool assembly over an arc of partial revolution bisected by the desired direction change.

7. The method of claim 1 wherein the downhole tool assembly comprises a directional boring tool and changing direction of the borehole further comprises:

orienting the directional boring tool for the desired direction change solely by rotation of the inner member; and advancing the directional boring tool without rotation.

8. The method of claim 7 further comprising:

measuring the pitch of the directional boring tool;

advancing the directional boring tool without rotation for a first interval of distance;

rotating the directional boring tool with the inner member and simultaneously advancing the directional boring tool for a second interval of distance; and repeating the steps until a desired pitch is achieved.

9. The method of claim 1 further comprising selecting a diameter of the outer member which diameter is substantially similar to a diameter of the borehole drilled by the downhole tool assembly.

10. The method of claim 1 further comprising sizing an inner diameter of the borehole to substantially approximate an outer diameter of the outer member of the drill string.

11. The method of claim 1 further comprising sizing an inner diameter of the borehole to substantially approximate an outer diameter of the downhole tool assembly.

12. A downhole tool assembly for a dual member drill string, the dual member drill string comprising an outer member and an inner member disposed within the outer member, the downhole tool assembly comprising:

a bearing housing assembly connectable to a downhole end of the outer member of the drill string and characterized by an outer wall defining a bearing chamber with a straight central axis;

a directional boring tool; and a drive member characterized by a front portion, a body, and a rear portion, the front portion being adapted to be operatively connected in torque transmitting engagement to the directional boring tool, the body being supported within the interior bearing chamber, and the rear portion operably connectable in torque transmitting engagement with a downhole end of the inner member of the drill string.

13. The downhole tool assembly of claim 12 wherein only the drive member is adapted to rotate the directional boring tool.

14. The downhole tool assembly of claim 12 wherein the body of the drive member is supported by a plurality of bearings within the interior bearing chamber.

15. The downhole tool assembly of claim 12 further comprising a beacon adapted to detect an orientation of the downhole tool assembly and adapted to produce at least one signal indicative of the orientation of the downhole tool assembly.

16. The downhole tool assembly of claim 15 wherein the detected orientation of the downhole tool assembly comprises a pitch of the downhole tool assembly.

17. The downhole tool assembly of claim 12 further comprising a beacon housing assembly having a front end and a rear end, the rear end of the beacon housing assembly operatively connectable to the front portion of the drive member and the front end of the beacon housing assembly operatively connectable to the directional boring tool, the beacon housing assembly adapted to produce at least one signal indicative of an orientation of the directional boring tool.

18. The downhole tool assembly of claim 17 wherein the beacon housing assembly further comprises a beacon adapted to detect the orientation of the directional boring tool and to transmit at least one signal indicative of the orientation.

19. The downhole tool assembly of claim 18 wherein the orientation of the directional boring tool comprises pitch.

20. The downhole tool assembly of claim 17 wherein the beacon housing assembly and the drive member are integrally formed.

21. The downhole tool assembly of claim 12 wherein the directional boring tool comprises a drill bit; said drill bit providing a steering capability for the downhole tool assembly when operated in a particular way.

22. The downhole tool assembly of claim 21 wherein the drill bit comprises a flat blade bit.

23. The downhole tool assembly of claim 22 wherein the drill bit is attached to the downhole tool assembly at an acute angle to a longitudinal axis of the downhole tool assembly.

24. A horizontal directional drilling machine comprising:

a frame;

a dual member drill string comprising an outer member and an inner member disposed generally coaxially within the outer member, the outer member and inner members having first respective ends and second respective ends;

a dual-rotary drive system attachable to the frame and operatively connectable to the first respective ends of the dual-member drill string and adapted to rotate and advance the drill string; and a downhole tool assembly comprising a bearing housing assembly connectable to the second end of the outer member and characterized by an outer wall defining a bearing chamber with a straight central axis;

a directional boring tool; and a drive member characterized by a front portion, a body, and a rear portion, the rear portion operably connectable in torque transmitting engagement to the second end of the inner member, the body being supported within the interior bearing chamber, and the front portion being adapted to be operatively connected in torque transmitting engagement to the directional boring tool.

25. The drilling machine of claim 24 wherein the outer member is configured to have a substantially uniform outer diameter.

26. The drilling machine of claim 24 wherein the bearing housing assembly is configured to have an outer diameter that approximates a cutting diameter of the directional boring tool.

27. The drilling machine of claim 26 wherein the downhole tool assembly further comprises a beacon housing assembly configured to have an outer diameter approximating the outer diameter of the bearing housing assembly.

28. The drilling machine of claim 26 wherein the downhole tool assembly further comprises a beacon housing assembly configured to have an outer diameter less than the outer diameter of the bearing housing assembly.

29. A downhole tool assembly for a dual member drill string, the dual member drill string comprising an outer member and an inner member disposed within the outer member, the downhole tool assembly comprising:

a bearing housing assembly connectable to and extending from a downhole end of the outer member of the drill string and characterized by an outer wall defining a bearing chamber with a straight central axis, such that the housing assembly does not surround the outer member of the drill string;

a directional boring tool; and a drive member characterized by a front portion, a body, and a rear portion, the front portion being adapted to be operatively connected in torque transmitting engagement to the directional boring tool, the body being supported within the interior bearing chamber, and the rear portion operably connectable in torque transmitting engagement with a downhole end of inner member of the drill string.

* * * * *